US009297207B2

(12) United States Patent
Schicker et al.

(10) Patent No.: US 9,297,207 B2
(45) Date of Patent: Mar. 29, 2016

(54) DOWNHOLE SINUSOIDAL VIBRATIONAL APPARATUS

(75) Inventors: Owen Schicker, Timaru (NZ); Enda Hand, Timaru (NZ)

(73) Assignee: FLEXIDRILL LIMITED, North Shore (NZ)

( * ) Notice: Subject to any disclaimer, the term of this patent is extended or adjusted under 35 U.S.C. 154(b) by 243 days.

(21) Appl. No.: 14/119,625

(22) PCT Filed: May 23, 2012

(86) PCT No.: PCT/NZ2012/000073

§ 371 (c)(1),
(2), (4) Date: Feb. 10, 2014

(87) PCT Pub. No.: WO2012/161595

PCT Pub. Date: Nov. 29, 2012

(65) Prior Publication Data

US 2014/0196952 A1 Jul. 17, 2014

Related U.S. Application Data

(60) Provisional application No. 61/489,409, filed on May 24, 2011.

(51) Int. Cl.
*E21B 7/24* (2006.01)
*E21B 31/00* (2006.01)

(52) U.S. Cl.
CPC ..... *E21B 7/24* (2013.01); *E21B 31/005* (2013.01)

(58) Field of Classification Search
CPC ..... E21B 7/024; E21B 31/005
See application file for complete search history.

(56) References Cited

U.S. PATENT DOCUMENTS 3,076,153 A * 1/1963 Rieckman ..... H02K 33/18 310/22
7,757,783 B2 * 7/2010 Pfahlert ..... B06B 1/045 175/55
2010/0212967 A1 * 8/2010 Powell ..... E21B 28/00 175/106
2010/0224410 A1 9/2010 Wassell et al.
2013/0133909 A1 * 5/2013 Greenwood ..... B06B 1/04 173/90

FOREIGN PATENT DOCUMENTS

NZ WO 2009028964 A1 * 3/2009 ..... B06B 1/04

OTHER PUBLICATIONS

International Search Report; PCT/NZ2012/000073; Nov. 13, 2012.
Written Opinion of the International Searching Authority; PCT/NZ2012/000073; Nov. 13, 2012.

* cited by examiner

*Primary Examiner* — Giovanna C Wright
(74) *Attorney, Agent, or Firm* — Studebaker & Brackett PC

(57) ABSTRACT

A device in place as, or suitable for use as, a vibrational tool of or in a downhole assembly, the device having a first magnetic assembly which is to be, or can be, rotated relative to a second magnetic assembly and which, when so rotated, causes the second magnetic assembly to oscillate and/or reciprocate at least substantially in an axial manner; wherein the oscillating and/or reciprocating magnetic assembly, at least substantially, at either one end, or both ends, is attached to and constrained in its oscillations and/or reciprocation by a compliant member thereby allowing the output force to be distributed to the outer body of the vibrational tool and/or any attached uphole and/or downhole tooling, from the compression and extension of the compliant member in a substantially sinusoidal manner.

10 Claims, 3 Drawing Sheets

DOWNHOLE SINUSOIDAL VIBRATIONAL APPARATUS

The present invention relates to a drill string included apparatus (e.g. device) able to output non-percussive (and preferably substantially sinusoidal) vibrations.

In the field of deep hole drilling and in particular extended reach horizontal wells there is frequently a need for a vibrating mechanism, which when required is energised to help avoid pipes (drill stings etc) from getting stuck—or indeed to free stuck pipes. This is particularly so in extended reach operations.

We have as an object, the provision of apparatus (eg. a device) able to be included as part of a drill string and able to provide relative axial movement which can be used through a compliant zone to output useful vibrational excitation.

In our U.S. Pat. No. 7,757,783 and WO 2012/002827 (full disclosure to both patents are herein included by way of reference). We disclose the use of magnetic arrays that interact responsive to a relative rotation thereby to convert the relative rotation into a relative axial movement as a vibrational apparatus. In U.S. Pat. No. 7,757,783 we disclose an apparatus including an assembly having a shuttle capable of shuttling between complementary structures, at least one of which complementary structures provides the vibrational output. The shuttle carries at each end magnetic arrays, each to interact out of phase with a dedicated complementary magnetic array as the shuttle is rotated, thereby causing the vibration to be generated axially relative to the shuttling of the shuttle with respect to the complementary arrays. In WO 2012/002827 we disclose first and second magnetic assemblies each with magnetic arrays set out from the common axis yet around the common axis and longitudinally of the common axis. It is the interactions between the magnetic arrays across the longitudinally extending annular space between them, consequential to the relative rotation that provides a relative drive longitudinally of the common axis. These arrangements could be used in the present invention.

It is a further and alternative object to provide the use of a compliant imposition(s) on the vibrational output of a device on demand downhole actuable to cause relative axial movement and/or a vibrational device on demand actuable by relative rotational input to cause axial relative movement outputting via compliant constraints on the extent of the axial relative movement.

It is a further and alternative object to provide the use of a compliant imposition(s) on the vibrational output of a device on demand downhole actuable to cause relative axial movement and/or a vibrational device on demand actuable by relative rotational input to cause axial relative movement outputting via compliant constraints.

It is an objective of the present invention, and is an aspect of the present invention, to provide a method for providing a sinusoidal vibration to avoid drill strings (or similar) sticking, preferably reliant upon rotating a first magnetic assembly (inside, for example, a casing) operatively associated with a second magnet assembly such that relative rotation caused by the rotation of the first magnetic assembly—by any suitable means (eg. a hydraulic, electric, mechanical, pneumatic etc) leads to a relative reciprocation axially of the magnetic assembly—the reciprocating assembly is preferably fixed to a compliant member (e.g. spring) at either or both ends so that such reciprocation preferably provides a sinusoidal output of sufficient force to achieve the objectives.

Ideally this type of device would have any one or more of the following characteristics.

- It could be activated "on demand"
- It would ideally provide a sinusoidal output
- It is able to have the output force controlled (amplified as required)
- It can fit anywhere in the drill string
- There could be multiple units in the drill string—each able to be activated as required
- It would be energised by any suitable means (hydraulic, electric, mechanical etc)
- It can be controlled at surface and or by a downhole feedback mechanism
- It could be used in conjunction with other downhole tools (e.g. drilling, milling, reaming, fishing, screen setting, cementing etc)

The present invention at least in preferred forms describes a mechanism to achieve any one or more of the above objectives.

The invention can relate to a vibrational apparatus, a drill string assembly comprising such a vibrational apparatus and/or a method of use of such an apparatus or drill string assembly.

In another aspect the invention is the use of a compliant imposition(s) on the vibrational output of a device on demand downhole actuable to cause relative axial movement.

In still another aspect the invention is a downhole assembly of any of the kinds herein after described.

In yet a further aspect the invention is a vibrational device on demand actuable by relative rotational input to cause axial relative movement outputting via compliant constraints on the extent of the axial relative movement.

Preferably the compliant constraints allow little or no movement prior to onset of the build up of the constraint. For instance, a spring tether between a reaction surface and the mass that is oscillated may be a sufficient constraint to satisfy the output criteria.

Whilst mechanical spring, pneumatic, magnetic, hydraulic, accumulator, elastomer or other like arrangements are contemplated, any single or multiple option that suffices can be used. By way of example suitable springs as the compliant members can be tubular, bellows-like, helical, or other.

In another aspect the invention is a device in, or suitable for, a drillstring which has a first magnetic assembly which is rotated relative to a second magnetic assembly, by any suitable manner, which when rotated causes a second magnetic assembly, being rotationally constrained—preferably synchronously with the drill string, to reciprocate at least substantially in an axial manner whereby;

the oscillating magnetic assembly, at least substantially, is attached at either one or both ends, and constrained by, a compliant member (eg. spring) thereby allowing the output force to be distributed to the outer body of the tool, and the or any attached uphole/downhole tooling, from the compression and extension of the compliant member in a substantially sinusoidal manner.

In another aspect the invention is a device in place as, or suitable for use as, a vibrational tool of or in a downhole assembly, the device having a first magnetic assembly which is to be, or can be, rotated relative to a second magnetic assembly and which, when so rotated, causes the second magnetic assembly to oscillate and/or reciprocate at least substantially in an axial manner; wherein the oscillation and/or reciprocating magnetic assembly, at least substantially, at either one end, or both ends, is attached to and constrained in its oscillations and/or reciprocations by a compliant member thereby allowing the output force to be distributed to the outer body of the vibrational tool and/or any attached uphole and/or downhole tooling, from the compression and extension of the compliant member in a substantially sinusoidal manner.

Preferably the device is in a downhole assembly.

Preferably the second magnetic assembly is constrained to be synchronous in rotation with the outer body of the vibrational tool.

Preferably the device can be controlled in an "on demand" manner by way of a suitable power source—preferably being hydraulic mud flow, electrical power or pneumatic energy.

Preferably the frequency of oscillation and/or reciprocation can be controlled by control of the input power source (eg. hydraulic mud flow, electrical power or pneumatic power to an input device).

Preferably the manipulation of the input speed controls the amplification of force.

Optionally the device is powered by drilling mud (hydraulically).

Preferably there is a bypass mechanism or configuration (eg. requiring a threshold flow rate for activation) which allows the drilling mud to pass without energising the device. For instance a PDM may allow mud flow through without being active up to some threshold flow rate above which there is both flow through and activation as an input device.

Optionally, on demand control is by change in mud flow/pressure/electrical signal/ball drop or any other suitable means, optionally the device is on demand operable.

Preferably the device can be placed, or is in place, anywhere in the drill string. Optionally multiple units can be or are used.

Optionally either the uphole vibration or downhole vibration may be dampened/controlled by a compliant member (spring/accumulator/elastomers, etc).

Preferably the device uses a substantially non compressible fluid within its cross section to minimise pressure differential sealing issues.

Preferably such a mechanism is with a pressure compensating device. Preferably the mechanism has various chambers of various viscosity (e.g. thicker viscosity for bearings, and thinner viscosity for ease of oscillation).

Preferably the device has a centre drilling fluid pathway that preferably is of a uniform cross section able to operate with viscous drilling fluids.

Preferably the device can be or is positioned either above or below, or both, a rotational power source (eg. a PDM).

Optionally the power source has a dual rotational output thereby enabling the vibrational device to be located above the rotational power source and some other tool (e.g. a drill bit/milling tool etc) to be located below the power source. Alternatively the vibration device with an output shaft could be used to transmit rotary drive from the PDM via the rotating magnetic assembly to a tool (e.g drill bit) below the vibration device in the drill string.

Preferably the device can be used (but not limited to) in conjunction with the following downhole applications;

shifting valves
setting plugs
Washouts
setting screens
sand control in screens
milling
scale removal
cementing
core sampling
drilling
fishing for stuck tools
used in wire line applications As used herein "device" in relation to a vibrational device is any apparatus, discrete or nondiscrete, able to operate to generate vibration from within a drill string As used herein "sinusoidal" includes true sinusoidal or somewhat similar wave forms.

As used herein the role of the "compliant imposition", the "compliant constraint", and the like is not to allow free movement during vibrational output when the movement is towards the end of its stroking, nor to convert all kinetic energy to potential energy, but rather, to output the near sinusoidal or true sinusoidal outputs.

As used herein the term "and/or" means "and" or "or", or both.

As used herein the term "(s)" following a noun includes, as might be appropriate, the singular or plural forms of that noun.

A preferred form of the present invention will now be described with reference to the accompanying drawings in which FIG. 1 shows in cross-section, as a first embodiment or option, an assembly where there is spring constraint at each end.

Figure 1:
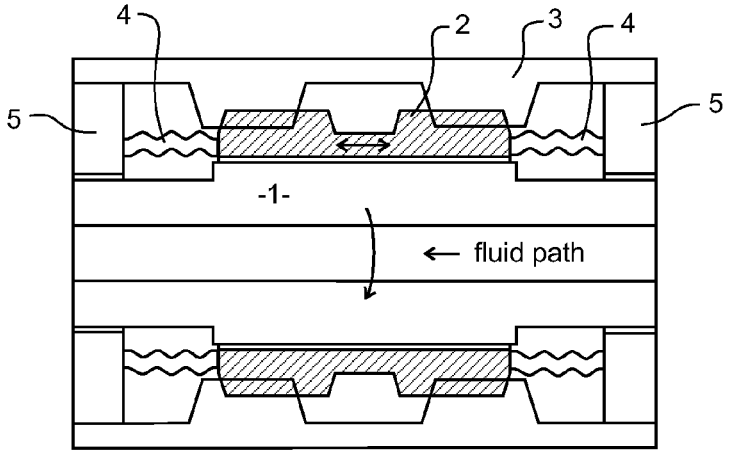

The FIG. 1 diagram, in a first embodiment shows a rotary input (PDM or similar) turning a first magnetic assembly (1). A fluid path extends through the first magnetic assembly. This assembly can be considered a rotor (1), which can rotate for example as shown by arrow A. This magnetic assembly (1) in turn magnetically reacts with the second magnetic assembly (2) which is optionally rotationally constrained by a spline(s) (3) of the outer casing (i.e. as a stator relative to the drillstring or the casing) causing the mass of the second magnetic assembly (2) to oscillate/reciprocate axially (see Arrow B).

The oscillating mass/second magnetic assembly (2) is physically connected to a compliant member (springs or other compliant form(s) and/or material(s)) (4) at each end which eliminates/constrains any collision between assemblies (2) and (4) and results in sinusoidal or substantially sinusoidal movement of the oscillating mass. A resulting sinusoidal force (or substantially sinusoidal force) is transmitted via thrust bearings (5) and/or compliant members (4) to the outer housing (and optionally any uphole and/or downhole tooling). This output can be used to eliminate friction. The compliant member can also at least partially rotationally constrain the second magnetic assembly.

The drilling fluid has a preferably unconstrained pathway through the tool via the fluid path shown.

Preferably a PDM is used as the input and requires a threshold flow rate for device activation.

Figure 2:
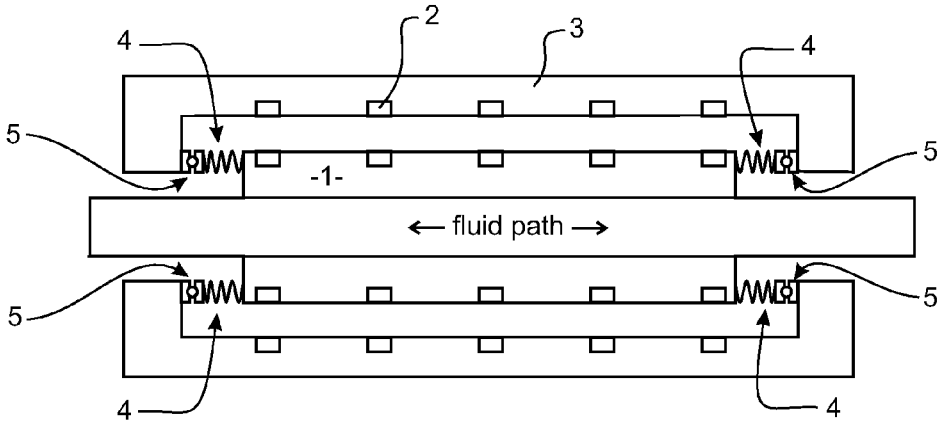
FIG. 2 shows in cross-section, as a second embodiment or option, an assembly where there is spring constraint at each end.

An alternative embodiment to the apparatus shown in FIG. 1 is shown in FIG. 2. It comprises an inner magnetic assembly with magnetic elements (1*a*) that forms an inner rotor (1). A fluid path extends through the inner rotor. The outer housing (3) comprises an outer magnetic assembly with magnetic elements (2) & (2*a*). The outer housing is synchronised to rotate with the drill string. Rotation of the inner magnetic assembly causes it to magnetically react with the outer magnetic assembly causing the mass of the inner magnetic assembly to oscillate/reciprocate axially (see Arrow B). The inner magnetic assembly is physically connected to the outer magnetic assembly via a compliant member(s) (springs or other compliant form(s) and/or material(s)) (4) and thrust bearings (5) at each end which eliminates any collision between assemblies (1) and (3) results in sinusoidal or substantially sinusoidal movement of the oscillating mass of the inner magnetic assembly. The output force (sinusoid) is transmitted to the outer housing via the springs (4) and thrust bearings (5) to the outer housing (3). Rotational constraint of the inner magnetic assembly is at least partially provided by the compliant member(s). The embodiment of FIG. 3 shows a similar tool as in embodiment 1—except in this case the oscillating mass (2) is physically constrained by a spring (4) or other compliant member(s) at only one end.

In this configuration the spring (4) acts in both compression and tension.

The spring can be positioned at either end.

Figure 3:
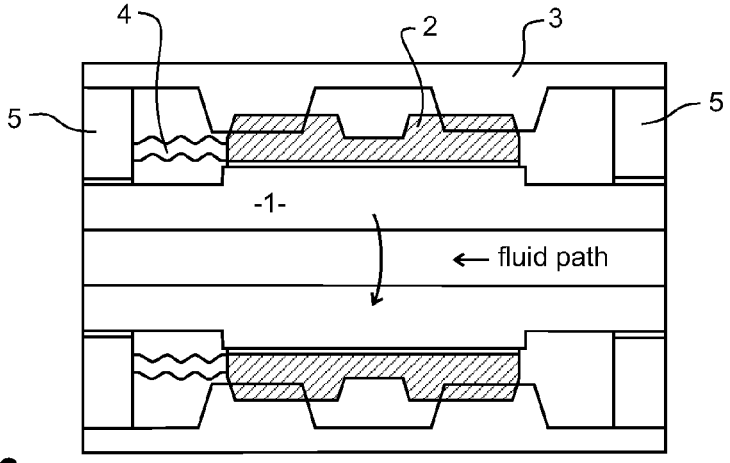
FIG. 3 shows in cross-section a third embodiment or option (with similarities to that of FIG. 1) but with single ended constraint by a spring.

In the five alternatives of FIGS. 4 to 8 there is shown various placement options in a drill string assembly for the apparatus shown in FIGS. 1 to 3. In each of FIGS. 4 to 8 there is shown drill rod (6), a PDM (7), a vibrational apparatus of the present invention (8) (such as that in shown FIGS. 1 to 3), a bit, jet, etc. downhole tool/application (9), and optionally an electric motor (10) and/or a wireline (11).

Figure 4:
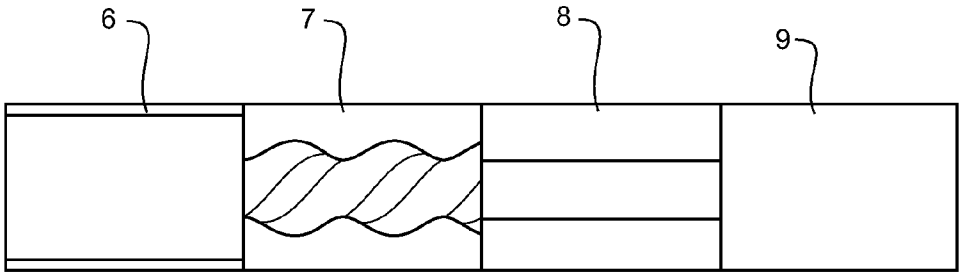
FIG. 4 shows a first option/embodiment for downhole placement of the apparatus of FIG. 1, 2 or 3.
Figure 5:
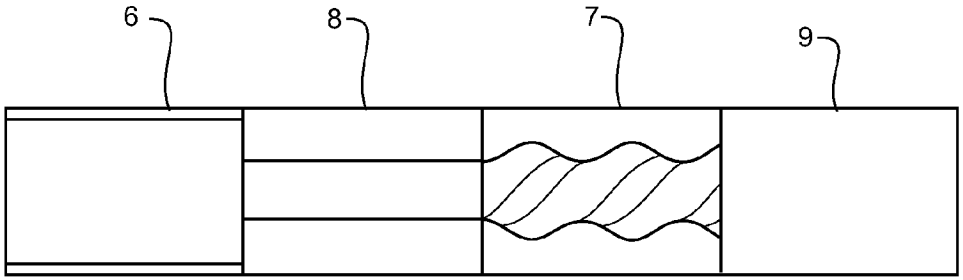
FIG. 5 shows a second option/embodiment for downhole placement of the apparatus of FIG. 1, 2 or 3.

FIGS. 4 and 5 show how the vibratory tool (apparatus) of FIGS. 1 to 3 can be placed downhole, for example on coil tube rod, threaded drill rods, or wire line either before or after the PDM.

Figure 6:
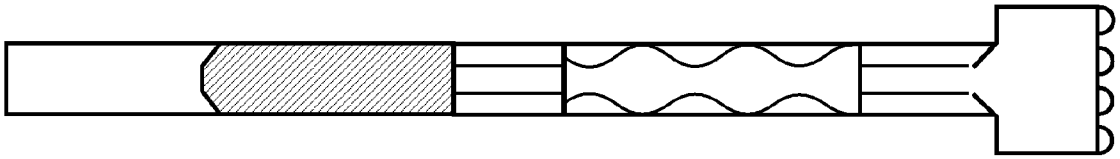
FIG. 6 shows in a manner similar to FIG. 4 a third placement option of the apparatus where the PDM has a dual output and is between both the vibratory apparatus and other downhole tool such as a drill bit for example and powers both.

FIG. 6 also shows the potential to use a PDM (7) (positive displacement motor) with a dual output shaft (uphole and downhole) allowing the device of the present invention to be placed above the PDM (normally it would be below a PDM) providing useful friction eliminating vibrations, while allowing the downhole output from the PDM to rotate other drilling tools (e.g. drill bits (9)).

Figure 7:
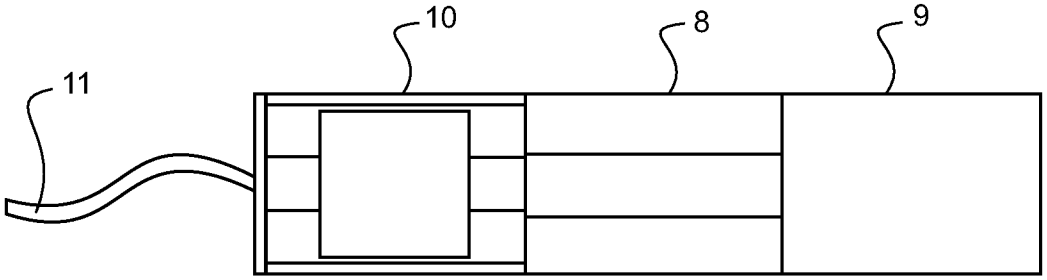
FIG. 7 shows in a manner similar to FIGS. 4 to 6 a fourth placement option.

FIG. 7 shows a wireline/electric motor option. This option allows for the wireline (11) to carry out the function of providing an electrical power source to drive an electric motor (10) to power the vibratory apparatus (8).

Figure 8:
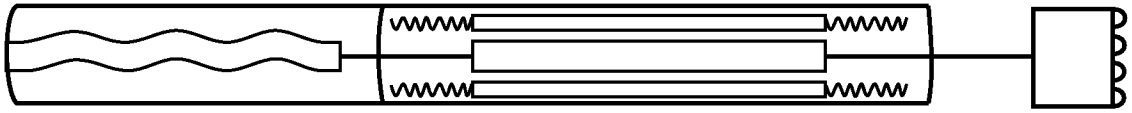
FIG. 8 shows FIG. 4 in more detail, where the PDM powers the vibratory apparatus along with a downhole tool attached to or adjacent to the vibratory apparatus.

FIG. 8 shows more detail of FIG. 4, where one possible option for a vibratory apparatus (8) and drilling tool (9) is shown. In this application, the output rotation from the PDM rotates one magnetic assembly (causing the vibratory device to oscillate) as well as providing a rotational drive to a down hole tool—e.g. a drill bit Friction reduction has been shown to be beneficial in the drilling process, in numerous ways such as;

- assisting with the weight that can be applied to the drill bit
- Reducing sliding friction—(when steering the bit—the drill string and assembly are often required to be pushed (without rotation for long distances)
- Stop drill cuttings from settling and causing blockages/sticking
- Tool face control (pointing the bit in the desired direction)

Studies and physical tests in the art have shown that the introduction of controlled vibrations are particularly effective at minimizing friction, and in particular powerful—low frequency<50 Hz sinusoidal vibrations are known to be highly effective to minimise drill string friction.

In addition to being used to help reduce friction in downhole situations, it will be obvious to those skilled in the art that this type of apparatus can be used for a number of other functions such as—but not restricted to;

- fishing for stuck tools
- shifting valves
- setting plugs
- washouts
- setting screens
- sand control in screens
- milling
- scale removal
- cementing
- core sampling
- drilling

The invention claimed is:

1. A device for use as a vibrational tool and for use in a downhole assembly, the device comprising

- a first magnetic assembly rotatable relative to a second magnetic assembly and when so rotated, causing the second magnetic assembly to oscillate and/or reciprocate at least substantially in an axial manner;
- the second magnetic assembly having a compliant member at both ends, the second magnetic assembly being attached to and constrained in oscillations and/or reciprocation by the compliant members thereby promoting a sinusoidal or substantially sinusoidal output force to be distributed to an outer body of a vibrational tool from alternating compression and extension of the compliant members.

2. The device of claim 1, wherein the second magnetic assembly is constrained to be synchronous in rotation with the outer body of the vibrational tool.

3. The device of claim 1, wherein the first magnetic assembly is controlled by a power source including at least one of hydraulic mud flow, electrical power or pneumatic energy to an input device.

4. The device as in claim 3, wherein the frequency of oscillation and/or reciprocation is controlled by input from the power source.

5. The device of claim 4, wherein manipulation of an input speed of the input controls amplification of force.

6. The device as in claim 1, wherein one of uphole vibration or downhole vibration is dampened/controlled by said compliant member.

7. The device as in claim 1, wherein a substantially non compressible fluid is used to minimize pressure differential sealing issues.

8. The device of claim 7, wherein plural chambers contain various viscosity liquid content.

9. The device as in claim 1, wherein a center drilling fluid pathway of a uniform cross section is able to operate with viscous drilling fluids.

10. The device of claim 1, used in conjunction with at least one of the following downhole applications:

- shifting valves,
- setting plugs,
- setting screens,
- washouts,
- sand control in screens,
- milling,
- scale removal, cementing,
core sampling,
drilling,
fishing for stuck tools, and
used in wire line applications.

* * * * *